US005248844A

United States Patent [19]

Kunimoto

[11] Patent Number: 5,248,844

[45] Date of Patent: Sep. 28, 1993

[54] WAVEGUIDE TYPE MUSICAL TONE SYNTHESIZING APPARATUS

[75] Inventor: Toshifumi Kunimoto, Hamamatsu, Japan

[73] Assignee: Yamaha Corporation, Hamamatsu, Japan

[21] Appl. No.: 513,078

[22] Filed: Apr. 19, 1990

[30] Foreign Application Priority Data

| | | | |
|---|---|---|---|
| Apr. 21, 1989 | [JP] | Japan | 1-102378 |
| May 10, 1989 | [JP] | Japan | 1-116888 |
| May 10, 1989 | [JP] | Japan | 1-116889 |

[51] Int. Cl.[5] ..... G10H 5/00

[52] U.S. Cl. ..... 84/622; 84/625; 84/630; 84/DIG. 9; 84/DIG. 10; 84/DIG. 26

[58] Field of Search ..... 84/604-607, 84/622-625, 630, DIG. 26, DIG. 9, DIG. 10

[56] References Cited

U.S. PATENT DOCUMENTS

| | | | |
|---|---|---|---|
| 4,416,180 | 11/1983 | Ichigaya | 84/605 |
| 4,475,229 | 10/1984 | Frese | 84/DIG. 26 |
| 4,622,877 | 11/1986 | Strong | 84/604 |
| 4,633,500 | 12/1986 | Yamada et al. | 381/51 |
| 4,984,276 | 1/1991 | Smith | 84/630 X |

FOREIGN PATENT DOCUMENTS

| | | |
|---|---|---|
| 0248527 | 9/1987 | European Pat. Off. . |
| 63-40199 | 2/1988 | Japan . |

OTHER PUBLICATIONS

"Modeling Piano Sounds Using Waveguide Digital Filtering Techniques" Garnett, Guy E., ICMC Proceedings 1987, pp. 89-95.

*Primary Examiner*—William M. Shoop, Jr.
*Assistant Examiner*—Brian Sircus
*Attorney, Agent, or Firm*—Graham & James

[57] ABSTRACT

A musical tone synthesizing apparatus which synthesizes a musical tone signal in response to the wind instrument, brass instrument and the like provides an excitation circuit and a resonance circuit. The excitation circuit simulates the operations of the reed, mouth-piece and the like, while the resonance circuit which operates as the bi-directional transmission path simulates the resonance tube. The excitation signal generated from the excitation circuit is transmitted through the resonance circuit consisting of delay circuits and junction circuits. Thereafter, the transmitted signal is reflected by the terminal portion, and the reflected signal is transmitted through the resonance circuit and then fed back to the excitation circuit. Thus, the excitation signal is circulated in the loop consisting of the excitation circuit and resonance circuit. Based on the signal picked up from this loop, it is possible to obtain the synthesized musical tone signal which simulates the wind instrument tone and the like.

6 Claims, 11 Drawing Sheets

D3 147Hz
STRONG-BLOWING
TONE

D3 STANDARD
BLOWING TONE

D3 WEAK-BLOWING
TONE

D4 294Hz
STRONG-BLOWING
TONE

D4 WEAK-BLOWING
TONE

F4 349Hz
STRONG-BLOWING
TONE

F4 WEAK-BLOWING
TONE

A4 440Hz
STRONG-BLOWING
TONE

C5 523Hz
STRONG-BLOWING
TONE

WAVEGUIDE TYPE MUSICAL TONE SYNTHESIZING APPARATUS

BACKGROUND OF THE INVENTION

1. Field of the Invention

The present invention relates to a musical tone synthesizing apparatus which is adaptable to an electronic musical instrument.

2. Prior Art

The conventionally known electronic musical instrument provides a waveform memory which pre-stores a musical tone waveform generated from a non-electronic musical instrument (hereinafter, simply referred to as "acoustic instrument") and the like. Then, the stored musical tone waveform is read from the waveform memory in response to an operation of a performer, so that a musical tone is to be generated based on the read musical tone waveform. In addition, the high-grade electronic musical instrument carries out certain operation on the read musical tone waveform, or executes the process of synthesizing plural musical tone waveforms. Thus, such high-grade electronic musical instrument can reproduce the musical tone with high fidelity.

Meanwhile, sounds actually generated by the above-mentioned acoustic instrument will be varied in accordance with the performance technique or environmental condition. In case of the wind instrument such as the clarinet, its musical tone waveform, even in the same scale, is varied in accordance with the blowing intensity, so that the audience can feel such variation of the generated musical tone waveform as the variation of tone color. This phenomenon will be explained later.

In order to reproduce the above-mentioned musical tone waveforms full of variety with high fidelity, the electronic musical instrument must provide the waveform memory capable of storing many kinds of waveforms and operation means capable of executing the complicated waveform processings. However, it is difficult to embody such electronic musical instrument based on the conventional techniques.

In order to overcome the above-mentioned difficulty, Japanese Patent Laid-Open Publication No. 63-40199 discloses another conventional instrument which models on the tone-generation mechanism of the acoustic instrument to thereby reproduce the musical tone generated by the the acoustic instrument without using the waveform memory.

Next, description will be given with respect to the simulation model of the acoustic instrument and the musical tone synthesizing apparatus using the simulation model in case of the wind instrument.

FIG. 1 shows the most simple model of the wind instrument consisting of a resonance tube 1 and a reed 2 made of elastic materials. When the performer blows his breath 2A into the reed 2, the reed 2 is bent due to breath pressure PA in the inside direction of the tube 1 (i.e., direction 2F). Since the reed 2 is elastic, the reed 2 is vibrated by the breath 2A. As a result, the pressure wave (i.e., compression wave) of air is produced in the inside of the tube 1 and reed 2. Then, such compression wave F progresses toward a terminal portion 1E of the tube 1. Thereafter, the progressive compression wave F is reflected by the terminal portion 1E so that reflected compression wave R is occurred. This reflected compression wave R is returned to the reed 2. Thus, the reed 2 is affected by pressure PR corresponding to the reflected compression wave R. As a result, the following pressure P is applied to the reed 2.

$$P=PA-PR \tag{1}$$

Thus, the reed 2 vibrates in accordance with the above-mentioned pressure P and elastic characteristic thereof. FIG. 2 shows an example of the elastic characteristic of the reed 2, i.e., relation between the pressure P (i.e., INPUT) and displacement of the reed 2 (i.e., OUTPUT). As shown in FIG. 2, the displacement of the reed 2 varies in connection with the pressure with non-linear curve. If the pressure P reaches certain saturation level, the displacement of the reed 2 does not vary.

In the case where the vibration frequency of the reed 2 becomes equal to the resonance frequency of the tube 1 (which will be described later), the resonance phenomenon will occur so that the large compression wave is obtained from the tube 1. Due to such large compression wave, the wind instrument can produce the sound.

More specifically, in the case where the air vibration is occurred at the specific frequency (i.e., resonance frequency) determined by scale L of the air column of the tube 1, the standing wave of the air compression wave is produced in the direction of scale L (i.e., longitudinal direction of tube 1), so that the large vibration is obtained in the tube 1. This phenomenon is called as the foregoing "resonance phenomenon".

Next, description will be given with respect to the relation between the above-mentioned scale L of the tube 1 and wavelength of the standing wave. If both edges of the tube are open as shown in FIG. 3 so that the air particles can freely move at the edge portions of the tube, amplitudes of the compression waves F and R go maximum. In this case, the reflected compression wave R has the inverse phase of the progressive compression wave F at the terminal portion. Therefore, wavelength "w" of the standing wave which is produced in the tube 1 is indicated by the following formula (2).

$$w=2L/n \tag{2}$$

, where n=1, 2, 3, . . . FIG. 3 shows three standing waves when n equals 1, 2, 3 respectively.

In contrast, when one edge of the tube is closed as shown in FIG. 4 so that the air particles cannot move at the closed edge portion of the tube, amplitudes of the compression waves F and R become zero. Therefore, wavelength w of the standing wave can be indicated by the following formula (3).

$$w=4L/(2n-1) \tag{3}$$

, where n=1, 2, 3, . . . FIG. 4 shows three standing waves when n equals 1, 2, 3 respectively.

When the air vibration having resonance frequency fn (as indicated by the following formula (4)) is given to the tube 1 by the reed 2, the foregoing resonance phenomenon occurs in the tube 1.

$$fn=c/w \tag{4}$$

, where c represents propagation velocity of the compression wave F, R.

Thereafter, since the reed 2 vibrates in synchronism with the standing wave in the tube 1, the resonance is maintained in the tube 1. More specifically, when the reed 2 is bent in direction 2F, the progressive compression wave F is produced. Then, this compression wave F is reflected by the terminal portion 1E so that the reflected compression wave R is produced. Thereafter, this reflected compression wave R bends the reed 2 in direction 2R (which is the inverse of the direction 2F) so that another progressive compression wave F is produced. This wave F is reflected by the terminal portion 1E and then returned to the reed 2. Therefore, another reflected compression wave R bends the reed 2 in direction 2F again. Thus, reed 2 continues to vibrate in synchronism with reciprocating motion of the compression wave (i.e., vibration of the standing wave).

As described heretofore, the reed 2 vibrates in synchronism with the standing wave of the compression wave in the tube 1 so that the resonance is maintained and consequently the wind instrument can generates the sound continuously. Herein, the reed 2 vibrates in non-linear manner, so that the compression waves F, R include higher harmonic components. In addition, the tube 1 has a plenty of different resonance frequencies as indicated in the foregoing formulae (2), (3). Thus, it is possible to obtain the air vibrations having different resonance frequencies in the tube 1.

FIG. 5 is a block diagram showing an electric configuration of the musical tone synthesizing apparatus which is obtained by simulating the tone-generation mechanism of the wind instrument as described heretofore. Incidentally, this configuration as shown in FIG. 5 is not limited to the wind instrument, but it is possible to apply this configuration to other instruments such as the string instrument.

In FIG. 5, 11 designates a non-linear element which simulates the operation of the reed 2, 12 designates a resonance circuit which simulates the tube 1, and 13 designates a subtractor which simulates the foregoing subtraction operation (1) which is applied to the reed 2. This subtractor 13 subtracts an output signal of the resonance circuit 12 (corresponding to the foregoing reflected compression wave R) from an input signal VA (corresponding to the foregoing breath pressure PA). Then, the subtraction result of the subtractor 13 is supplied to the non-linear element 11.

According to the configuration as shown in FIG. 5, DC bias is effected on the non-linear element 11 by the input signal VA. Then, the output of the non-linear element 11 is supplied to the resonance circuit 12. Thereafter, the output of the resonance circuit 12 is supplied to the non-linear element 11 via the subtractor 13, so that the non-linear element 11 is excited. Thus, the circuit shown in FIG. 5 carries out the oscillation operation.

Herein, the non-linear element 11 is designed such that its I/O characteristic will simulate the non-linear characteristic of the reed 2. This non-linear element 11 can be embodied by the known non-linear element such as the diode. Or, the non-linear element 11 can be embodied by a read-only memory (ROM) which stores the desirable non-linear function to be read out. As described above, the I/O characteristic of the non-linear element 11 can be designed to coincide with that of the reed. Thus, it is possible to obtain the output waveform of the non-linear element 11 which coincides with the vibration waveform of the reed.

FIGS. 6A–6I illustrate several vibration waveforms of the reed in the clarinet. As can be seen in the figures, strongly-performed tone and weakly-performed tone both belonging to the same musical scale have different vibration waveforms so that these tones are sounded in different tone colors in the wind instrument such as the clarinet. Herein, the vibration waveform of the weakly-performed tone is close to sine-waveform. On the other hand, the level of the vibration waveform of the strongly-performed tone is limited into the range defined by LL and LU which are determined by the elastic limit of the reed, so that the peak-portion of the vibration waveform of the strongly-performed tone must be distorted as compared to that of the sine-waveform. Such waveform distortion can be indicated by the variation of the output waveform of the non-linear element 11 whose bias-point is varied by the input signal VA corresponding to the breath pressure PA. In case of the weakly-performed tone, the bias-point of the non-linear element 11 is limited in certain linear range since the breath pressure PA is relatively small, so that the output signal of the non-linear element 11 has the waveform close to the sine-waveform. In case of the strongly-performed tone, the bias-point of the non-linear element 11 is in the non-linear range since the breath pressure PA is relatively large, so that the output signal of the non-linear element 11 has the waveform including a plenty of higher harmonic components.

Next, description will be given with respect to the resonance circuit 12 in detail. This resonance circuit 12 is designed to correspond to the shape of the resonance tube of the wind instrument to be simulated. FIG. 7 illustrates the transmission-frequency characteristic of the resonance tube of the clarinet, while FIG. 8 illustrates the transmission-frequency characteristic of the resonance tube of the oboe. As shown in FIGS. 7 and 8, the transmission-frequency characteristic of the tube of the wind instrument has a plenty of peak portions each corresponding to each of the resonance frequencies which are determined by the tube shape. Incidentally, the relation between the resonance frequency and tube shape can be indicated by the foregoing formulae (2), (3). Thus, the air vibration produced by the reed of each wind instrument is applied to the resonance tube, so that each wind instrument can generate the sound having the specific and unique tone color.

FIG. 9 illustrate the circuit which is obtained by simulating the transmission-frequency characteristic of the tube portion of the wind instrument. This circuit shown in FIG. 9 can be used as the foregoing resonance circuit 12 shown in FIG. 5. In FIG. 9, $DF_1$ to $DF_n$, $DR_1$ to $DR_n$ designate delay circuits each configured by the multi-stage shift register (having three stages or more in general). These delay circuits simulate the transmission delay of the compression wave in the tube. Herein, the delay circuits $DF_1$, $DR_n$ correspond to the tube portion which is the closest to the reed 2, while $DF_n$, $DR_1$ correspond to the tube portion which is the closest to the end portion 1E. The delay circuit $DF_1$ inputs the output signal of the non-linear element 11 shown in FIG. 5, whereas the subtractor 13 inputs the output signal of the delay circuit $DR_n$.

$J_1$, $J_2$ in FIG. 9 designate junction circuits each simulating the scattering of compression wave which occurs at the portion of connecting two tube portions each having the different diameter in the resonance tube of the wind instrument. Herein, each junction circuit "J" is designed as "four-multiplication-grid" consisting of multipliers $M_1$ to $M_4$ and adders $A_1$, $A_2$. In the junction circuit, "1+kn", "−kn", "1−kn", "kn" designate coefficients which are multiplied by the input signals of the multipliers $M_1$ to $M_4$. These coefficients are determined in response to the signal scattering characteristic of the wind instrument. Then, the signal transmission is made by the junction circuits among the neighboring delay circuits. For example, the output signal of the delay circuit $DF_1$ is sent to the delay circuit $DF_2$ via the multiplier $M_1$ in the junction circuit $J_1$, while the output signal of the delay circuit $DR_{n-1}$ is sent to the delay circuit $DR_n$ via the multiplier M3 in the junction circuit $J_1$.

Instead of the above-mentioned junction circuit, the foregoing Japanese Patent Laid-Open Publication No. 63-40199 discloses the junction circuit designed by "three-multiplication-grid" as shown in FIG. 10. In FIG. 10, $M_5$ to $M_7$ designate multipliers, $A_3$ to $A_5$ designate adders and IV2 designates an inverter. In addition, "kn" designates a coefficient which is multiplied by the input signal of the multiplier $M_7$. Similarly, "gm" and "1/gm" designate coefficients which are respectively multiplied by the multipliers $M_5$, $M_6$. Herein, the coefficient gm is determined by the following formula (5).

$$gm=[(1-kn)/(1+kn)]^{0.5}$$

By setting the coefficient as described above, the transmission gain is regulated.

In FIG. 9, TRM designates a terminal circuit which simulates the terminal portion 1E of the resonance tube 1. Herein, the output signal of the non-linear element 11 is passed through the delay circuits $DF_1$ to $DF_n$ and junction circuits $J_1$, $J_2$ . . . and then supplied to the terminal circuit TRM. ML designates a multiplier which simulates the energy loss which is occurred when the compression wave is reflected by the terminal portion 1E. This multiplier ML multiplies the output signal of the delay circuit $DF_n$ by certain loss coefficient gl, and then the multiplication result is supplied to a phase inverter IV. This phase inverter IV simulates the phase inversion which is occurred between the reflected wave and progressive wave when the terminal portion 1E is not closed but opened. Therefore, when the terminal portion 1E is closed, the phase inverter IV is not required. Then, DC components of the output signal of the phase inverter IV is removed by DC removing circuit DCB. Thereafter, the output signal of the DC removing circuit DCB is supplied to the delay circuit $DR_1$. This output signal is finally supplied to the adder 13 shown in FIG. 5 via the delay circuits $DR_n$ to $DR_1$ and the junction circuits $J_2$, $J_1$, . . .

The sum of delay times of the delay circuits $DF_1$ to $DF_n$, $DR_1$ to $DR_n$ is determined in response to the frequency of the musical tone to be sounded. Actually, the propagation velocity required when the progressive compression wave F propagates from the reed to the tube end portion coincides with the propagation velocity required when the reflected compression wave R propagates from the tube end portion to the reed in the wind instrument. For this reason, the circuit shown in FIG. 9 is designed such that the sum of delay times of the delay circuits $DF_1$ to $DF_n$ is set equal to the sum of delay times of the delay circuits $DR_1$ to $DR_n$.

As described heretofore, the non-linear element 11 and resonance circuit 12 shown in FIG. 5 are designed by simulating several portions of the wind instrument. By using the circuit shown in FIG. 5, it is possible to synthesize the desirable wind instrument tone. In case of the string instrument such as the guitar other than the above-mentioned wind instrument, the non-linear element 11 is designed in response to the elastic characteristic of the string and the resonance circuit 12 is designed in response to the length of the string, by which the circuit shown in FIG. 5 can simulate the string instrument tone. Meanwhile, it is possible to make the reverberation effect applying apparatus by use of the above-mentioned resonance circuit, for example.

Meanwhile, in the case where the operation of the musical tone synthesizing apparatus is embodied by operational processes executed by signal processors, the conventional musical tone synthesizing apparatus uses the foregoing four-multiplication-grid or three-multiplication-grid as the junction circuit, which thereby increases the times of carrying out the multiplication in each junction circuit. Therefore, in order to embody the desirable signal processing speed, the conventional apparatus requires high processing ability for the signal processor, which raises a problem in that the circuit configuration must be complicated. Instead of the foregoing grid circuits to be used as the junction circuit, it is possible to use other circuits as various junction circuits having various transmission characteristics. In this case, it is possible to obtain the variation of the signal processings by varying the coefficient to be used in each multiplier included in the junction circuit.

Next, description will be given with respect to the conventional reverberation effect applying apparatus by referring to FIG. 11. In FIG. 11, $SF_1$ to $SF_3$, $SR_1$ to $SR_3$ designate shift registers each simulating the transmission delay of reverberation tone; IV1A to IV3A, IV1B to IV3B designate inverters; $MA_1$ to $MA_3$, $MB_1$ to $MB_3$ designate multipliers each simulating the attenuation of reverberation tone; and A1A to A3A, A1B to A3B, A123, B123 designate adders each simulating the convolution of the reverberation tones which are convoluted in the acoustic space. In addition, each of three pairs of the shift registers $SF_1$, $SR_1$; $SF_2$, $SR_2$; $SF_3$, $SR_3$ corresponds to the transmission path of one reverberation tone in the acoustic space. Further, the number of stages of each shift register (represented by numerals $N_1$, $N_2$, $N_3$) is determined in response to the transmission delay time of the transmission path of reverberation tone to be simulated.

Next, description will be given with respect to the operation of the above-mentioned reverberation effect applying apparatus. In FIG. 11, the input signal corresponding to the musical tone is applied to the adder B123, and then the output of the adder B123 is supplied to the shift registers $SF_1$, $SF_2$, $SF_3$ via the adders A1A, A2A, A3A respectively. The input signal of the shift register $SF_1$ is delayed by the predetermined delay time and then inverted by the inverter IV1B. The output of the inverter IN1B is supplied to the shift register $SR_1$ via the adder A1B, wherein it is delayed by the predetermined delay time in the shift register $SR_1$. Thereafter, the output of the shift register $SR_1$ is fed back to the adder A1A via the inverter IV1A. Thus, the loop consisting of these elements A1A, $SF_1$, IV1B, A1B, $SR_1$, IV1A simulates the reverberation tone which transmits forth and back in the transmission path. Similarly, other loops consisting of the shift registers $SF_2$, $SR_2$, $SF_3$, $SR_3$ etc. simulate other transmission paths.

Meanwhile, the outputs of the shift registers $SF_1$, $SF_2$, $SF_3$ are multiplied by loss coefficients $a_1$, $a_2$, $a_3$ in the multipliers $MA_1$, $MA_2$, $MA_3$ respectively. Then, outputs of the multipliers $MA_1$ to $MA_3$ are added together in the adder A123. The output of the adder A123 is delivered to the adders A1B, A2B, A3B respectively. On the other hand, the outputs of the shift registers $SR_1$, $SR_2$, $SR_3$ are multiplied by loss coefficients $b_1$, $b_2$, $b_3$ in the multipliers $MB_1$, $MB_2$, $MB_3$ respectively. Then, the outputs of the multipliers $MB_1$ to $MB_3$ are added together in the adder B123. The output of the adder B123 is delivered to the adders A1A, A2A, A3A respectively. Thus, the signal which propagates each shift register is attenuated, which simulates the attenuation of the reverberation tone. As a result, the adder A123 can output the musical tone to which the reverberation effect is applied.

Meanwhile, the foregoing musical tone synthesizing apparatus as shown in FIG. 9 provides the delay circuits $DF_1$ to $DF_n$ for the progressive compression wave and other delay circuits $DR_1$ to $DR_n$ for the reflected compression wave, wherein the delay times are set equal in both of DF and DR. Therefore, the number of the delay circuits to be provided must be increased in response to the kind of the musical tone to be simulated. This enlarges the hardware of the musical tone synthesizing apparatus. In addition, when the musical synthesizing operation is carried out by the operation of the signal processor, the times of accessing the memory must be increased. Further, the musical tone is not sounded until the output signal of the non-linear element passes through the delay circuits $DF_1$ to $DF_n$, which deteriorates the real-time operation of synthesizing the musical tone.

Lastly, FIG. 12 shows another conventional musical tone synthesizing apparatus which simulates the tone-generation mechanism of the wind instrument. In FIG. 12, 21 designates a read-only memory (ROM), 22 designates an adder, 23 designates a subtractor, and 24, 25, 26 designate multipliers, all of which configures an excitation circuit 20 which simulates the operations of mouth-piece and reed of the wind instrument such as the clarinet.

Next, description will be given with respect to stored information of the ROM 21. Of course, the wind instrument is performed by that the performer holds the mouth-piece in his mouth and then blows his breath into the gap between the mouth-piece and reed. In this case, the sectional area of the above-mentioned gap is varied in response to the sum of the air pressure in the gap and reed pressure (which is called "Embouchure" in French) applied to the reed when the performer holds the mouth-piece in his mouth. The relation between the whole pressure applied to the reed and the sectional area of the gap is set based on the elastic characteristic of the reed, so that non-linear relation will be established between them. The ROM 21 stores a non-linear function table representative of the relation between the reed pressure (i.e., input PP) applied to the reed and the sectional area (i.e., output S) of the gap. Herein, based on input data PP corresponding to the reed pressure to be used as the address, the output data S corresponding to the sectional area of gap can be read from the table.

27 in FIG. 12 designates a filter which simulates the transmission characteristic of the resonance tube of the wind instrument.

In FIG. 12, the subtractor 23 receives information P representative of the blowing pressure applied to the wind instrument and information q supplied from the filter 27. This information q corresponds to the compression wave which inversely flown into the mouth-piece from the tube of the wind instrument. The subtractor 23 subtracts the information q from the information P to thereby output information $\Delta P$ representative of the pressure in the mouth-piece. Then, the adder 22 adds the information $\Delta P$ with information E corresponding to the foregoing reed pressure applied to the reed when the performer holds the mouth-piece in his mouth. Thus, the adder 22 outputs information PP representative of the whole pressure applied to the reed. This information PP is supplied to the ROM 21.

Then, the ROM 21 outputs information S corresponding to the sectional area of gap to the multiplier 25. Meanwhile, the multiplier 24 multiplies the information $\Delta P$ with "$-1$" to thereby output "$-\Delta P$" to the multiplier 25. Herein, the pressure information $\Delta P$ represents the pressure of the progressive compression wave which directs from the reed into the tube, while "$-\Delta P$" represents the pressure of the reflected compression wave which directs from the tube end to the reed. Due to the multiplication carried out by the multiplier 24 by use of the multiplication coefficient "$-1$", the above-mentioned pressure information $\Delta P$ is converted into $-\Delta P$. In the multiplier 25, the information S corresponding to the sectional area of the gap formed between the mouth-piece and reed is multiplied by the information $-\Delta P$ corresponding to the gap pressure applied to the gap, so that multiplication result FL is obtained. This information FL corresponds to the flow velocity of the air-flow which passes through the gap.

Then, the multiplier 26 multiplies the above-mentioned information FL by information G representative of the flow-resistance which avoids the air-flow passing through the inlet of the tube (i.e., the portion near the reed-mounting-portion of the tube). Thus, the multiplier 26 outputs information X representative of the pressure of the progressive compression wave which progresses into the tube. This information X is supplied to the filter 27, from which the information q representative of the pressure of the air-flow which inversely flows toward the reed is outputted to the subtractor 23. Thereafter, as described before, the information X is obtained from the multiplier 26 and supplied to the filter 27.

As described heretofore, the information corresponding to the pressure of the air-flow is circulated in the closed-loop consisting of the excitation circuit 20 and filter 27. In short, the resonance operation is carried out in such closed-loop. Then, based on the musical tone information picked up from the predetermined node of the filter 27, the musical tone is to be generated.

The above-mentioned conventional musical tone synthesizing apparatus as shown in FIG. 12 is suitable to the wind instrument (such as the clarinet or saxophone) in which the reed movement depends on the pressure $\Delta P$ at the gap formed between the mouth-piece and reed. However, such conventional apparatus cannot be applied to the brass instrument such as the trumpet which utilizes the performer's lip as the reed, wherein the performer's lip is called "lip reed". The reasons are described below.

In the case where the lip opening degree is relatively small when using the lip reed, the mouth-inside pressure forces the lip to open, while the air pressure applied from the tube (hereinafter, simply referred to as tube-side pressure) forces the lip to close. However, if the lip opening degree becomes relatively large, the tube-side pressure does not affect the lip movement anymore. In short, in case of the lip reed, when the mouth-inside pressure and tube-side pressure are varied, the lip opening degree must be varied even if the pressure difference between them is not changed. Therefore, it is not possible to directly determine the lip opening degree based on the pressure difference between the mouth-inside pressure and tube-side pressure. For this reason, there is a problem in that the conventional apparatus cannot synthesize the musical tone of the brass instrument.

SUMMARY OF THE INVENTION

It is accordingly a primary object of the present invention to provide a musical tone synthesizing apparatus capable of carrying out the signal processings full of variety on the musical tone.

It is another object of the present invention to provide a musical tone synthesizing apparatus capable of synthesizing the musical tone in real-time manner.

It is still another object of the present invention to provide a musical tone synthesizing apparatus capable of synthesizing the musical tone of the brass instrument.

In a first aspect of the present invention, there is provided a musical tone synthesizing apparatus comprising:

(a) excitation means for outputting an excitation signal based on an input signal and a feedback signal; and (b) bi-directional transmission means for transmitting the excitation signal outputted from the excitation means to a terminal portion as a progressive wave signal and also feeding back the progressive wave signal reflected by the terminal portion to the excitation means as a reflected wave signal, wherein a musical tone signal on which a synthesizing operation is effected is obtained by setting the excitation means and the bi-directional transmission means at resonance states.

In a second aspect of the present invention, there is provided a musical tone synthesizing apparatus comprising:

(a) excitation means for generating an excitation signal based on an input signal corresponding to a performance operation and its feedback signal;

(b) signal transmission means for transmitting the excitation signal back to the excitation means as a feedback signal with a predetermined delay time, wherein a signal circulated in a loop consisting of the excitation means and signal transmission means is picked up as a musical tone signal on which a synthesizing operation is effected.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

DESCRIPTION OF PREFERRED EMBODIMENTS

Next, description will be given with respect to preferred embodiments of the present invention.

[A] FIRST EMBODIMENT

Figure 13:
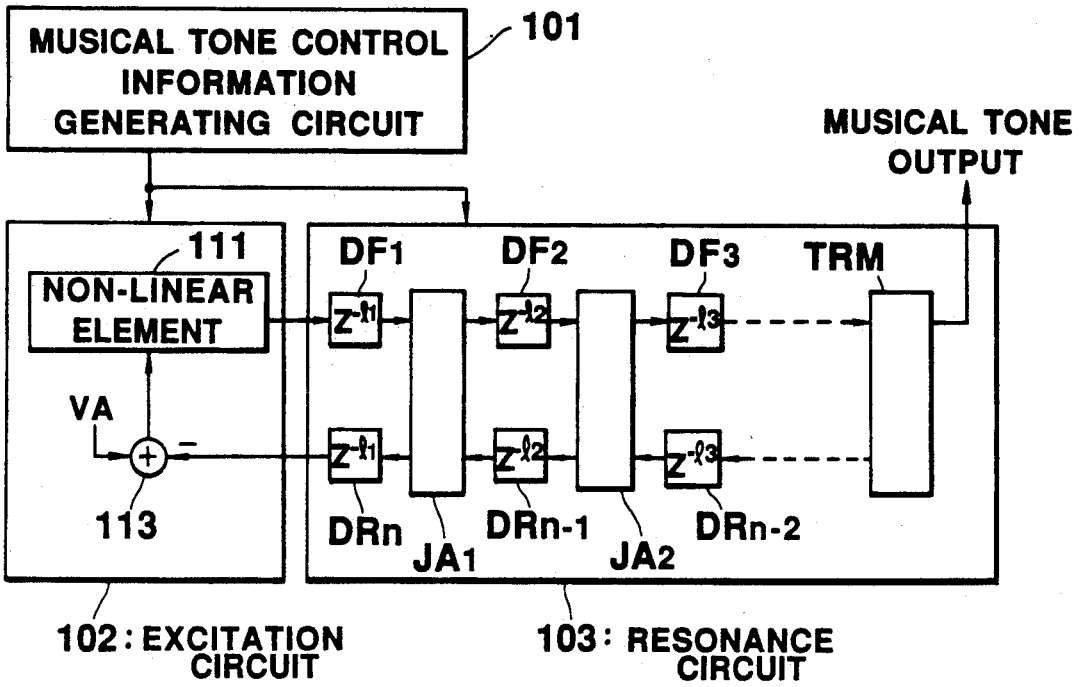
FIG. 13 is a block diagram showing the musical tone synthesizing apparatus according to a first embodiment of the present invention.

FIG. 13 is a block diagram showing the electric configuration of the musical tone synthesizing apparatus according to the first embodiment of the present invention. In FIG. 13, 101 designates a musical tone control information generating circuit which generates musical tone control information (representative of the scale, blowing intensity, note-on event, note-off event etc.) in accordance with the detected operation of each manual operable member provided on the wind instrument (not shown). In addition, 102 designates an excitation circuit consisting of a non-linear element 111 and a subtractor 113 similar to 11, 13 shown in FIG. 5. The non-linear element 111 receives the information representative of the blowing intensity from the musical tone control information generating circuit 101 as DC bias VA.

103 designates the resonance circuit which simulates the resonance tube of the wind instrument. Herein, the resonance frequency of the resonance circuit 103 is changed over in accordance with the scale information supplied from the musical tone control information generating circuit 101. The change-over control of resonance frequency can be carried out by changing over the number of substantial states of the delay circuits $DF_1$, $DF_2$, $DR_1$, $DR_2$ etc. in the resonance circuit 103. As the most simple method of carrying out such change-over control of resonance frequency, it is possible to provide switching means such as the selector and the like (not shown) by which the non-linear element 111 to be connected to any one of the delay circuits DF is selectively connected to the delay circuit DFi (where i=1, 2, . . .) and the subtractor 113 to be connected to any one of the delay circuits DR is selectively connected to the delay circuit DRj (where j=n, n−1, . . . ). In FIG. 13, the closed-loop is established among the non-linear element 111, resonance circuit 103, subtractor 113, wherein the signal is circulated in the order: 111→103→113→111. However, there remains a possibility in that the closed-loop is in the self-running oscillation condition due to the noises. In order to avoid such self-running oscillation condition, the non-linear element 111 is set in the enable state at the note-on timing, i.e., the non-linear element 111 is not set in the enable state at the note-off timing.

$JA_1$, $JA_2$, . . . designate junction circuits each of which can be constructed by the grid circuits other than the foregoing four-multiplication-grid and three-multiplication-grid. More specifically, each junction circuit can be constructed by two-multiplication grid (see FIG. 14A), one-multiplication-grid (see FIG. 14B) or four-multiplication-regulated-grid (see FIG. 14C).

Figure 9:
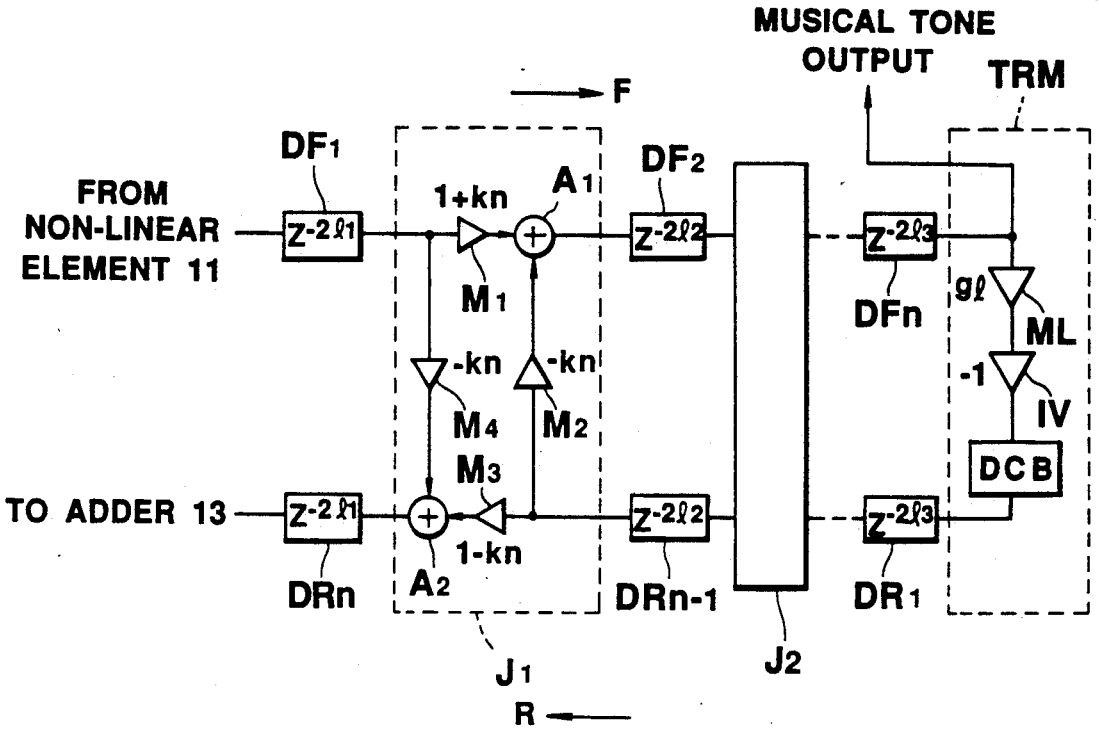
FIG. 9 (PRIOR ART)
FIG. 9 is a block diagram showing detailed configuration of the resonance circuit shown in FIG. 5.
Figure 10:
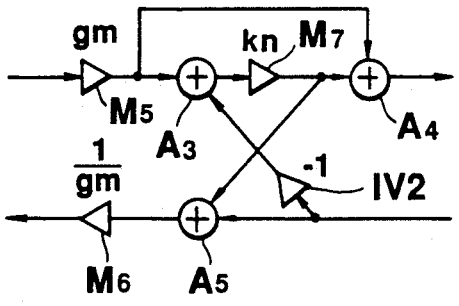
FIG. 10 (PRIOR ART)
FIG. 10 is a circuit diagram showing the detailed configuration of the junction circuit shown in FIG. 9.

Incidentally, all of the four-multiplication-grid (see FIG. 9), three-multiplication-grid (see FIG. 10), two-multiplication-grid (see FIG. 14A), one-multiplication-grid (see FIG. 14B) and four-multiplication-regulated-grid (see FIG. 14C) have the same transmission characteristic when the coefficient in each grid is constant. In other words, even if any one of the grids is used as the junction circuit JA in FIG. 13, the same musical tone output can be obtained.

However, in order to carry out the signal processings in the present musical tone synthesizing apparatus by carrying out the operation of the digital signal processor, the times of carrying out the multiplication operation can be reduced by using the two-multiplication-grid (see FIG. 14A) and one-multiplication-grid (see FIG. 14B) as compared to the four-multiplication-grid or three-multiplication-grid. Therefore, by using such grid as the junction circuit, it is possible to release the operation capacity and processing speed required in the digital signal processor.

Figure 14A:
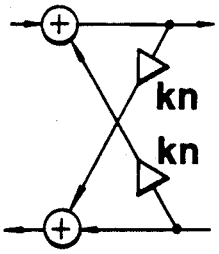
FIGS. 14A to 14C are circuit diagrams each showing the multiplication-grid to be applied to the junction circuit.
Figure 14B:
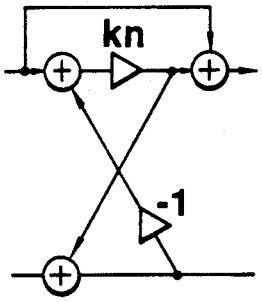
Figure 14C:
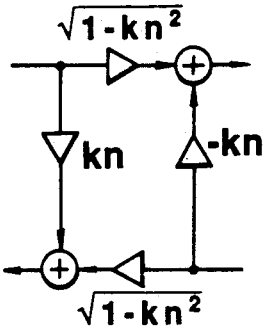

Meanwhile, the transmission gain is regulated in the four-multiplication-regulated-grid shown in FIG. 14C. For this reason, by using the four-multiplication-regulated-grid as the junction circuit, it is possible to avoid the event in that the signal level at each point in the resonance circuit 103 becomes extremely small or large. Therefore, the four-multiplication-regulated-grid can simplify the the level adjustment of the signal in the resonance circuit 103.

In the above-mentioned junction circuit, it is possible to vary the transmission characteristic of the junction circuit by independently varying the coefficient of each multiplier. By using the grids as shown in FIGS. 14A, 14B other than the four-multiplication-grid and three-multiplication-grid as the junction circuit, it is possible to obtain many kinds of the transmission characteristics of the junction circuit. By using the desirable grid as the junction circuit, it is possible to carry out the delicate musical tone control.

Incidentally, the first embodiment provides the delay circuits $DF_1$, $DF_2$ etc. for the progressive wave signal and other delay circuits $DR_1$, $DR_2$ etc. for the reflected wave signal, all of which have the same delay time. However, it is possible to modify the present invention such that different delay times are used for the delay circuits DF, DR respectively. In this case, by setting the sum of the delay times of the modified example to be identical to that of the delay times of the first embodiment, it is possible to generate the same musical tone output in both of the modified example and first embodiment.

In addition, the present embodiment discloses the musical tone synthesizing apparatus which simulates the wind instrument. However, it is possible to apply the present invention to the reverberation effect applying apparatus and the like. Further, in the present embodiment, both of the DC bias VA and feedback signal from the resonance circuit 103 are supplied to the non-linear element 111 via the subtractor 113. Instead, it is possible to use the non-linear table to which the DC bias VA and feedback signal are directly supplied.

[B] SECOND EMBODIMENT

Figure 15:
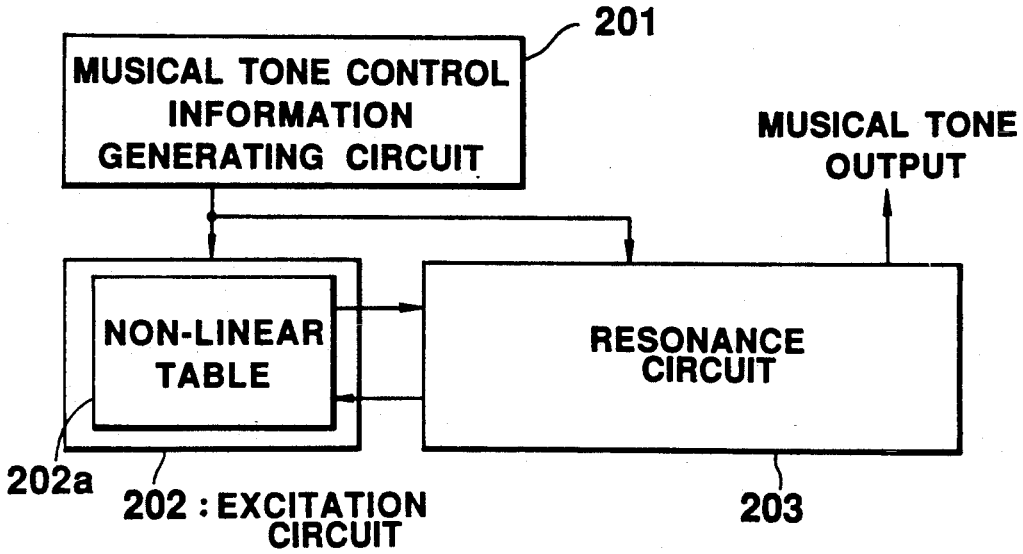
FIG. 15 is a block diagram showing the musical tone synthesizing apparatus according a second embodiment of the present invention.

Next, description will be given with respect to the second embodiment of the present invention. FIG. 15 is a block diagram showing electric configuration of the musical tone synthesizing apparatus according to the second embodiment of the present invention.

Figure 1:
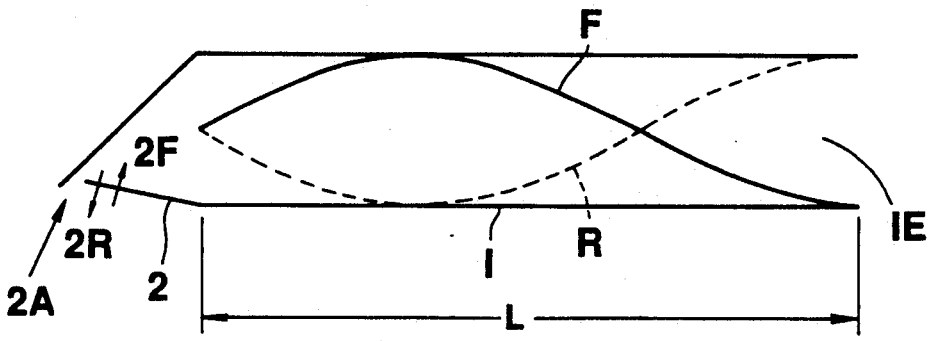
FIG. 1 is a conceptual view showing the construction and operation of the wind instrument to be performed.
Figure 2:
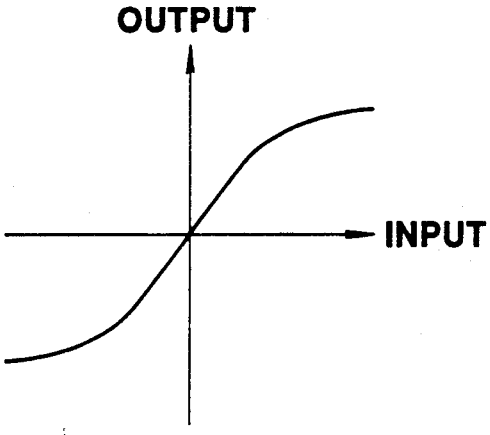
FIG. 2 shows non-linear elastic characteristic of the reed.
Figure 5:
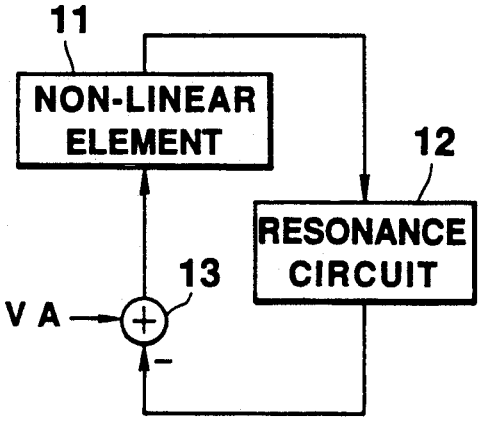
FIG. 5 (PRIOR ART)
FIG. 5 is a block diagram showing an electric configuration of the conventional musical tone synthesizing apparatus which simulates the operation of wind instrument.
Figure 3:
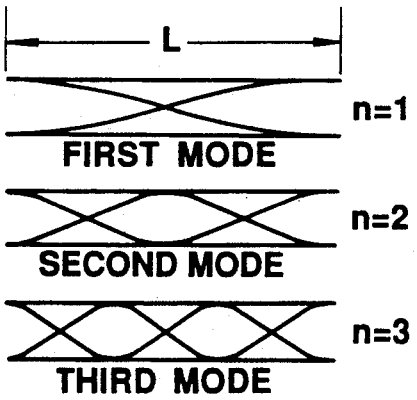
FIGS. 3, 4 show models for explaining standing waves in the resonance tube.
Figure 4:
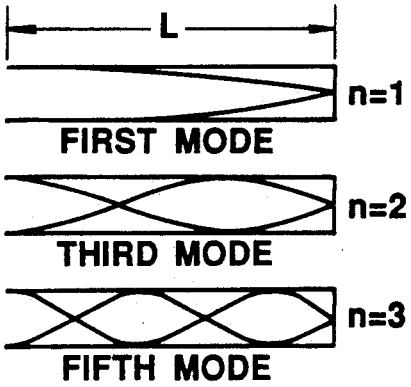
Figure 6A:
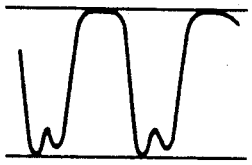
FIG. 6 shows vibration waveforms produced by the reed in the clarinet.
Figure 6B:
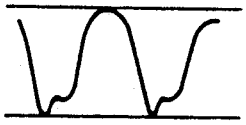
Figure 6C:
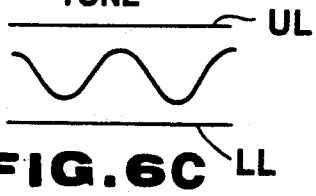
Figure 6D:
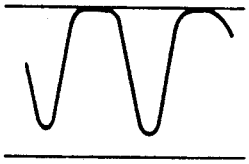
Figure 6E:
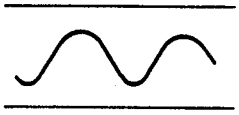
Figure 6F:
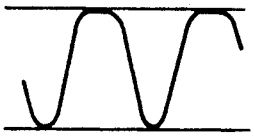
Figure 6G:
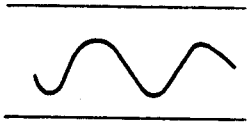
Figure 6H:
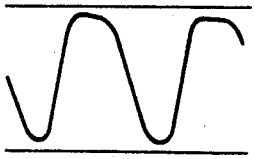
Figure 6I:
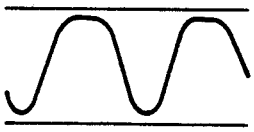
Figure 7:
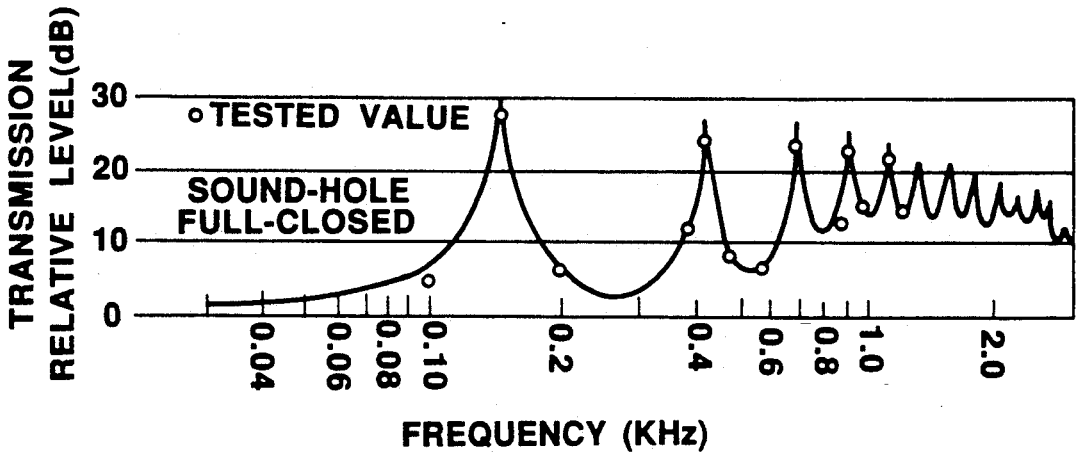
FIG. 7 shows the transmission-frequency characteristic of the resonance tube of the clarinet.
Figure 8:
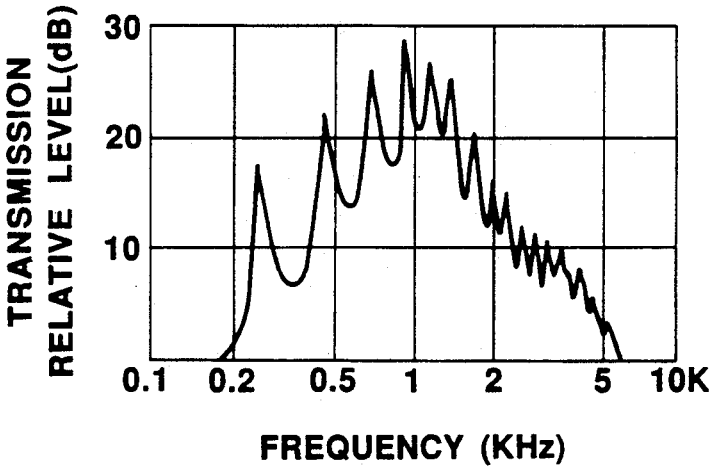
FIG. 8 shows the transmission-frequency characteristic of the resonance tube of the oboe.

In FIG. 15, 201 designates a musical tone control information generating circuit which generates musical tone control information (representative of the scale, blowing intensity, note-on event, note-off event etc.) in accordance with the detected operation of each manual operable member provided on the wind instrument (not shown). In addition, 202 designates an excitation circuit. This excitation circuit 202 can be constructed by the foregoing non-linear element 11 and subtractor 13 as shown in FIG. 5. However, in the second embodiment, this excitation circuit 202 is constructed by a non-linear table 202*a* which is constructed by the ROM from which the excitation signal is read based on the input VA, output signal of a resonance circuit 203 and musical tone control information from the circuit 201. Herein, the information representative of the blowing intensity is supplied to the non-linear table 202*a* from the musical tone control information generating circuit 201 as the DC bias VA. The resonance circuit 203 simulates the resonance tube of the wind instrument to be performed. The resonance frequency of this resonance circuit 203 is changed over by the information representative of the scale supplied from the musical tone control information generating circuit 201. As described before, the change-over control of the resonance frequency can be carried out by changing over the switching means such as the selector by which the number of stages of delay circuits is changed over. Further, in order to avoid the self-running oscillation of the closed-loop consisting of the non-linear table 202*a* and resonance circuit 203 due to the noises, the non-linear table 202*a* is set in the enable state at the note-on timing only as described before.

Figure 16A:
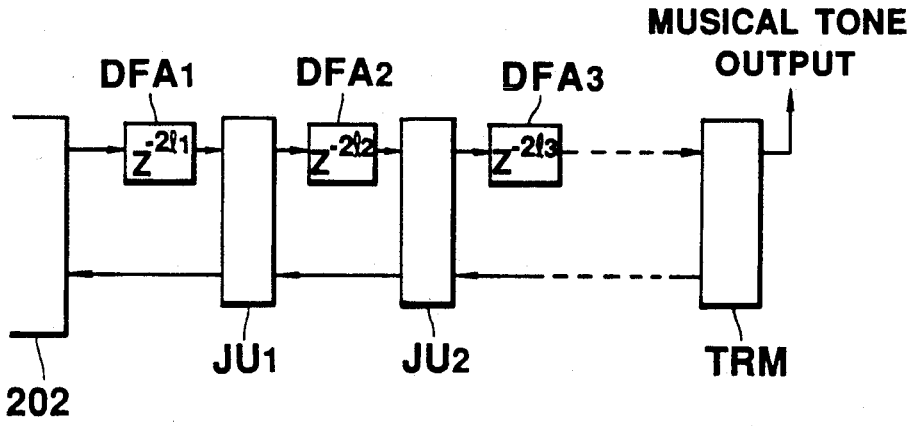
FIGS. 16A, 16B are block diagrams each showing the detailed configuration of the resonance circuit shown in FIG. 15.
Figure 16B:
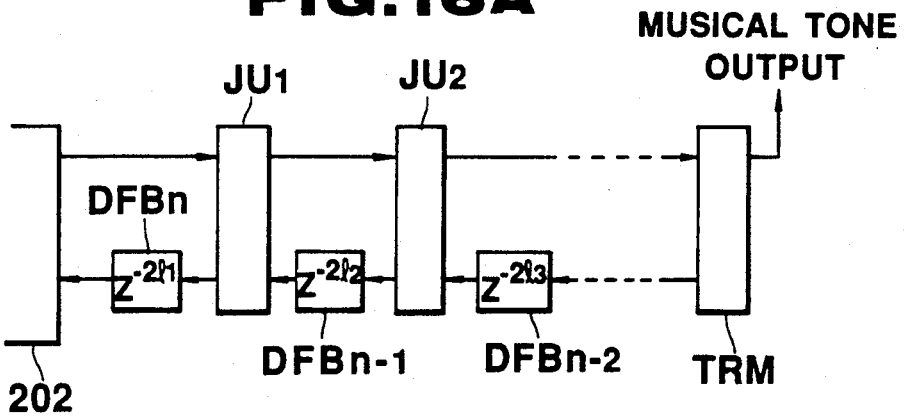
Figure 17A:
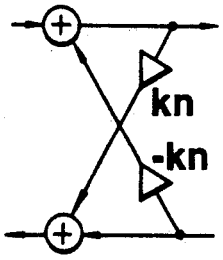
FIGS. 17A to 17C are circuit diagrams each showing the multiplication-grid.
Figure 17B:
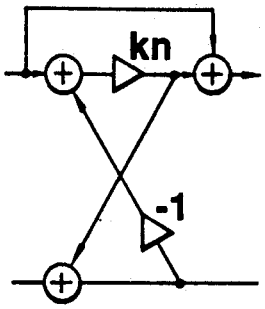
Figure 17C:
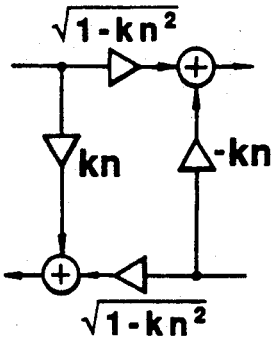

FIGS. 16A, 16B show the concrete configurations of the resonance circuit 203. As junction circuits $JU_1$, $JU_2$ etc., it is possible to use the two-multiplication-grid (see FIG. 17A), one-multiplication-grid (see FIG. 17B) and four-multiplication-regulated-grid (see FIG. 17C) other than the foregoing four-multiplication-grid. The resonance circuit as shown in FIG. 16A provides delay circuits $DFA_1$, $DFA_2$, . . . for the transmission path of the progressive wave signal, while another resonance circuit as shown in FIG. 16B provides delay circuits $DFB_1$, $DFB_2$, . . . for the transmission path of the reflected wave signal. In order to obtain the same musical tone output of FIG. 9, the delay times of the delay circuits DFA, DFB in FIGS. 16A, 16B must be respectively doubled as compared to those of the delay circuit DF, DR in FIG. 9. By setting such delay times for the delay circuits DFA, DFB, the resonance circuits shown in FIGS. 16A, 16B can have the same transmission-frequency characteristic of the resonance circuit shown in FIG. 9. In the resonance circuits of FIGS. 16A, 16B, the number of delay circuits to be required can be reduced to half of the number of delay circuits required in the conventional resonance circuit shown in FIG. 9. Further, in case of the resonance circuit shown in FIG. 16B, the output signal of the non-linear table 202*a* is directly transmitted to the terminal circuit TRM without passing through the delay circuits so that the musical tone can be immediately generated when the performer starts to generate the musical tone.

Next, description will be given with respect to an example in which the signal processing of the resonance circuit in the present musical tone synthesizing apparatus is carried out by the digital signal processor. In general, high-speed processing is required in the digital signal processor so that the digital signal processor normally carries out the operation based on the pipeline operation method. In such method, fetch operations of plural micro-instructions and plural operational stages are executed in parallel in time-overlapping manner so that the signal processing can be carried out with high speed. However, in the case where the output of certain junction circuit is directly transmitted to next junction circuit without passing through the delay circuit as shown in FIGS. 16A, 16B, it is necessary to pay a special attention to the execution of the operation of each junction circuit, which will be described below.

Figure 18:
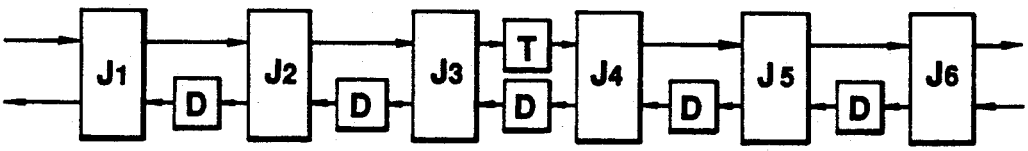
FIGS. 18 and 19 show operational processes to be executed by the second embodiment.
Figure 19:
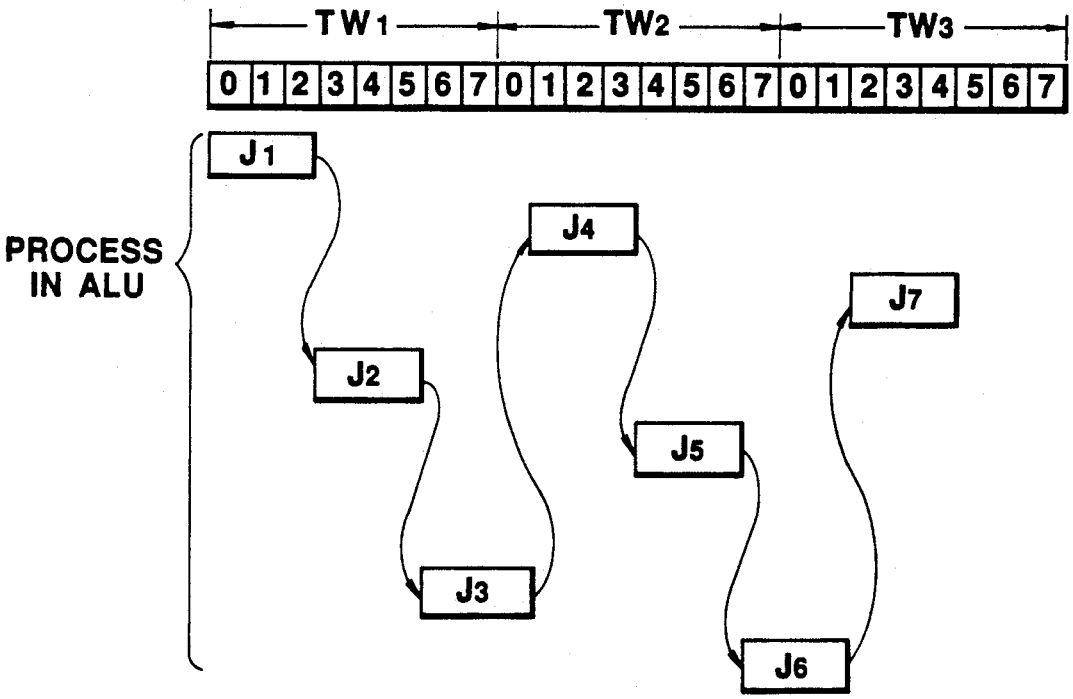

FIG. 18 is a block diagram showing the configuration of the resonance circuit shown in FIG. 16B whose signal processing is executed by the digital signal processor. In FIG. 18, each of $J_1$, $J_2$, . . . designates junction operational process, wherein $J_1$, $J_2$, . . . correspond to the operations (such as the addition and multiplication) to be executed by the junction circuits $JU_1$, $JU_2$, . . . respectively. Herein, the process results of $J_1$, $J_2$, . . . are temporarily held in the temporary register in the digital signal processor (not shown). In this case, the process result of $J_1$ is supplied to $J_2$ via the temporary register, for example. In addition, D designates the delay process corresponding to the delay circuit DFB. FIG. 19 is a conceptual view showing the operation of arithmetic-logic unit (ALU) which is required when the junction operational processes $J_1$, $J_2$ etc. are carried out by the digital signal processor. In FIG. 19, numbers "0" to "7" designate execution states of micro-instructions. Hereinafter, these execution states will be designated as $ST_0$ to $ST_7$ corresponding to the numbers "0" to "7" in each sample period TW shown in FIG. 19. In the present embodiment, the period corresponding to three execution states is required in order to obtain the process result of each junction operational process J. In addition, each sample period corresponds to eight execution states $ST_0$ to $ST_7$. In each sample period, the digital signal processor can compute and renew the digital signal values at several points of the resonance circuit.

As shown in FIG. 19, when the junction operational process $J_1$ is started at state $ST_0$ in first sample period $TW_1$, its process result is obtained at state $ST_2$. Therefore, the next junction operational process $J_2$ must be started at state $ST_3$. Similarly, the junction operational process $J_3$ is started at state $ST_6$ in $TW_1$; $J_4$ is started at $ST_1$ in $TW_2$; and $J_5$ is started at $ST_4$ in $TW_2$. Thus, each junction operational process can be started when its necessary data is obtained.

As described above, the junction operational processes $J_3$, $J_4$ are executed in different sample periods $TW_1$, $TW_2$ respectively, which causes the following problem. Herein, the the digital signal processor counts the delay time at each sample period, and the process result is transmitted from certain junction operational process to next junction operational process based on the count value, which corresponds to the delay process D. For this reason, when the sample period is changed over between the junction operational processes $J_3$, $J_4$, the present system judges that each process result is not produced in real-time manner but produced at the timing delayed by unit time. In order to avoid such event, the present system shifts back its operational time by unit time if the sample period is changed over just before the junction operational process is to be executed. T shown in FIG. 18 designates time correction process for shifting back the operational time by unit time.

Figure 20:
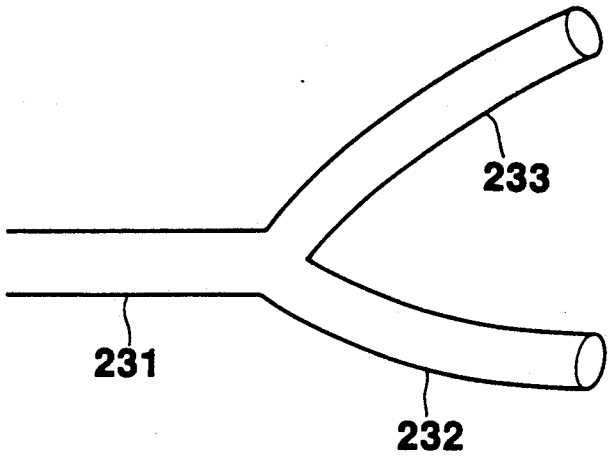
FIG. 20 shows the model of tube construction of another wind instrument.
Figure 21:
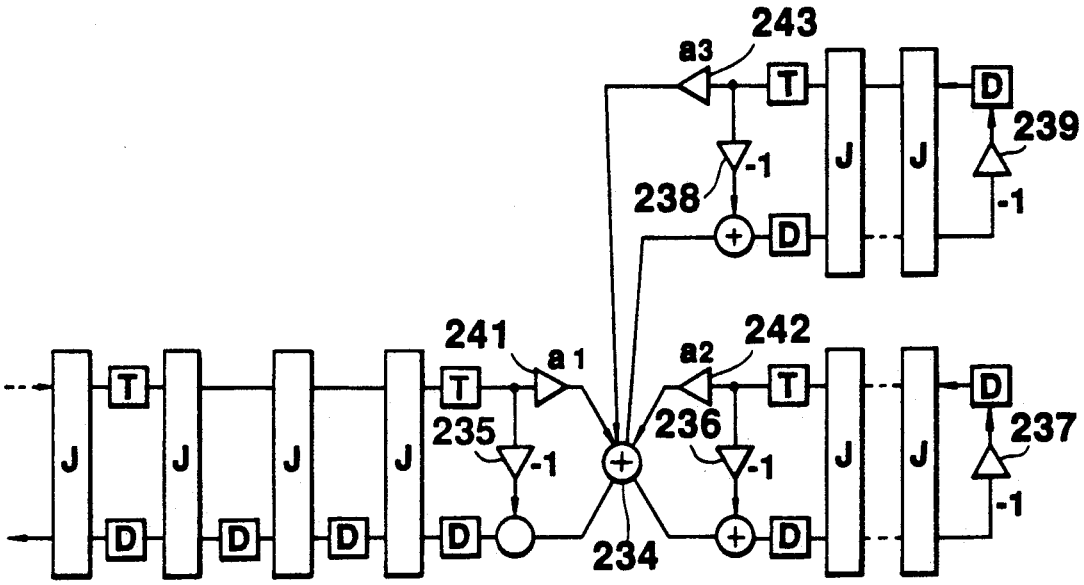
FIG. 21 shows operational processes corresponding to the tube construction shown in FIG. 20.

In the case where the resonance tube is constructed by connecting three tubes 231, 232, 233 as shown in FIG. 20, the signal processing simulating the compression wave propagation is carried out as shown in FIG. 21. In FIG. 21, J designates the junction operational process, and T designates the time correction process as similar to that shown in FIG. 18. In FIG. 20, the air pressure at the tube connecting portion coincides with the sum of the air pressures from three tubes 231, 232, 233. An adder 234 shown in FIG. 21 simulates the air pressure at the tube connecting portion. Herein, the circuit constructed by inverters 235 to 239, multipliers 241 to 243 simulate the reflection of the compression wave to be reflected at the tube connecting portion and terminal portions of tubes 232, 233. Even in this case wherein the resonance tube is constructed by three tubes, it is also possible to avoid the count error of the delay times due to the change-over of sample period by inserting the time correction process T between some junction operational processes J.

Figure 11:
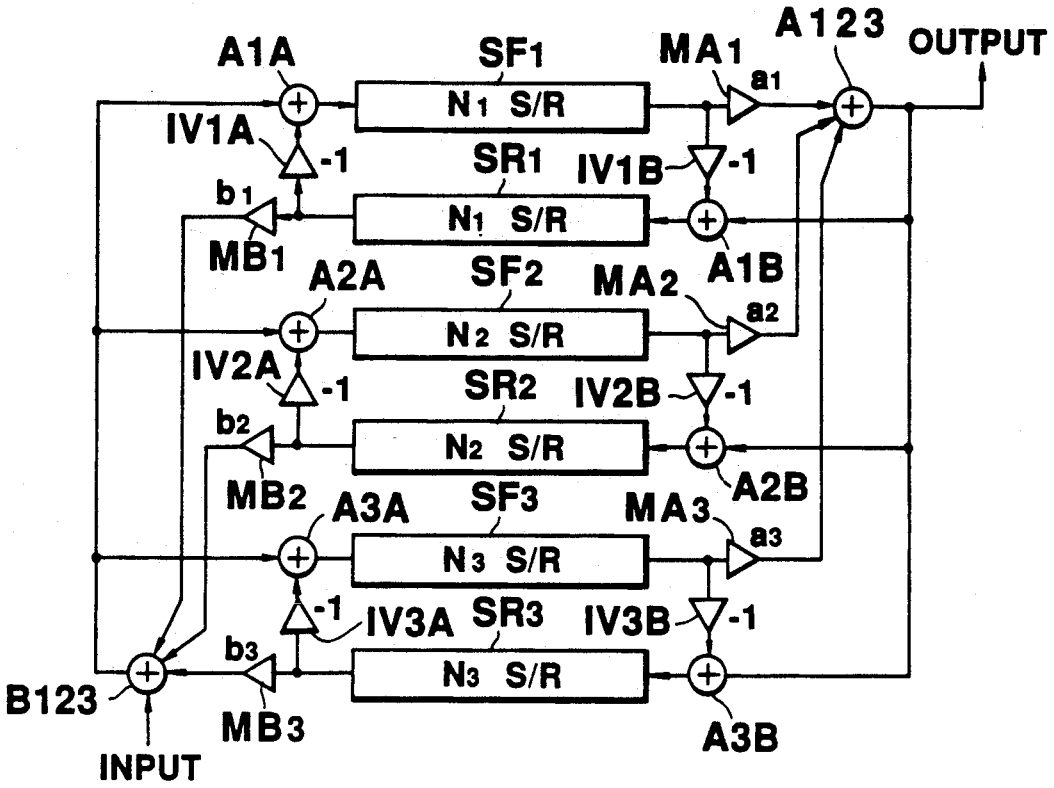
FIG. 11 (PRIOR ART)
FIG. 11 is a block diagram showing the electric configuration of the conventional reverberation effect applying apparatus using the conventional musical tone synthesizing technique.

Next, description will be given with respect to the reverberation effect applying apparatus according to the present invention by referring to FIG. 22, wherein parts identical to those shown in FIG. 11 will be designated by the same numerals, hence, detailed description thereof will be omitted. As comparing to the circuit shown in FIG. 11, the shift register $SF_1$is omitted and other shift registers $SR_1$ ($N_1$ stages), $SF_2$ ($N_2$ stages), $SR_2$ ($N_2$ stages), $SF_3$ ($N_3$ stages), $SR_3$ ($N_3$ stages) are respectively replaced by shift registers $SR_1A$ ($2N_1$ stages), $SF_2A$ ($N_2-N_1$ stages), $SR_2A$ ($N_2+N_1$ stages), $SF_3A$ ($N_3-N_1$ stages), $SR_3A$ ($N_3+N_1$ stages) in the circuit shown in FIG. 22. Other parts are identical between FIGS. 11 and 22.

Figure 22:
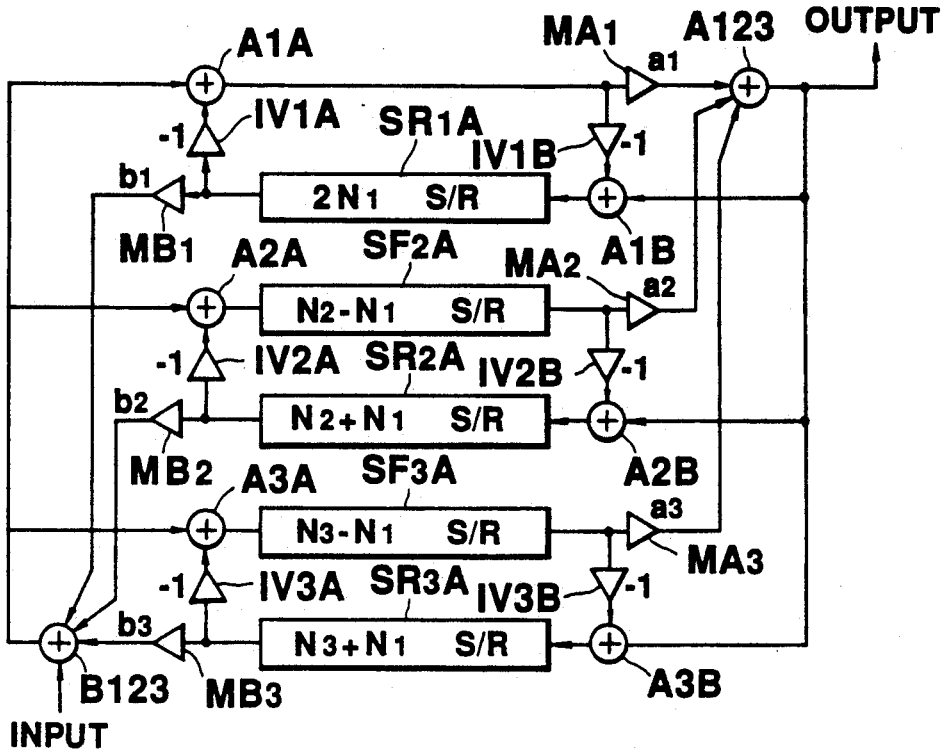
FIG. 22 is a block diagram showing the reverberation effect applying apparatus according to the present invention.

As described above, by omitting the shift register $SF_1$, it is possible to reduce the time required to generate first reverberation effect applied tone after the musical signal is inputted to the circuit shown in FIG. 22. As similar to FIG. 11, phase differences between the inputs and outputs of the adders A1A, A1B correspond to $2N_1$ stages of shift register; phase differences in the adders A2A, A2B correspond to $2N_2$ stages of shift register; and phase differences in the adders A3A, A3B correspond to $2N_3$ stages of shift register. Therefore, the phase differences among signals to be added in the adder A123, B123 in FIG. 22 are identical to those in FIG. 11, so that the circuit shown in FIG. 22 can carry out the signal processing equivalent to that of the circuit shown in FIG. 11.

[C] THIRD EMBODIMENT

Figure 12:
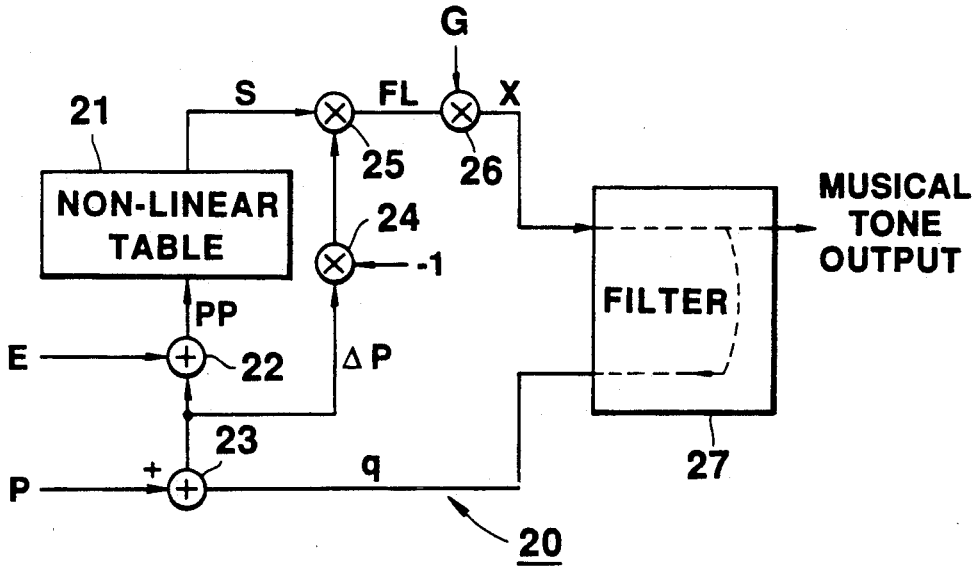
FIG. 12 (PRIOR ART)
FIG. 12 is a block diagram showing another conventional musical tone synthesizing apparatus
Figure 23:
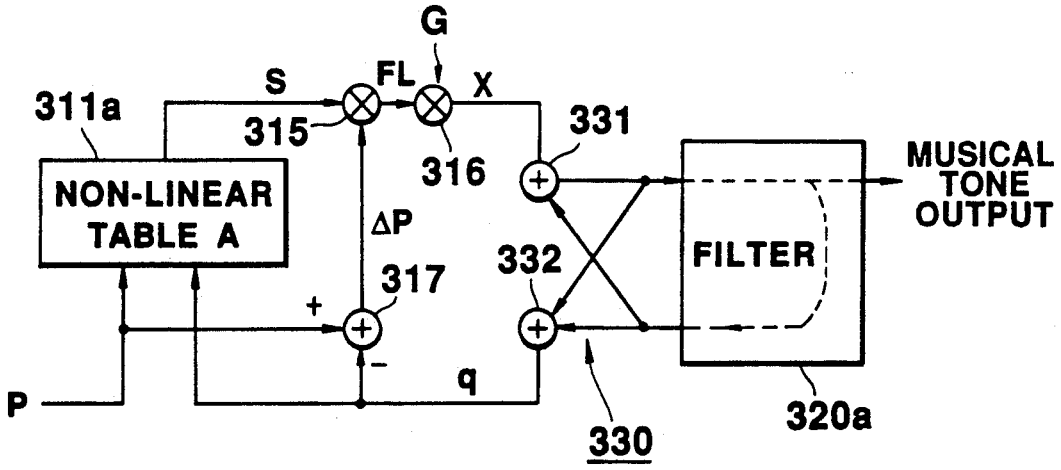
FIG. 23 is a block diagram showing the musical tone synthesizing apparatus according to a third embodiment of the present invention.

FIG. 23 is a block diagram showing the electric configuration of the musical tone synthesizing apparatus according to the third embodiment of the present invention. In FIG. 23 of which circuit configuration corresponds to that of FIG. 12, 311*a* designates a non-linear table A; 315, 316 designate multipliers; 317 designates a subtractor; 320*a* designates a filter; and 330, 331 designate adders.

Figure 24:
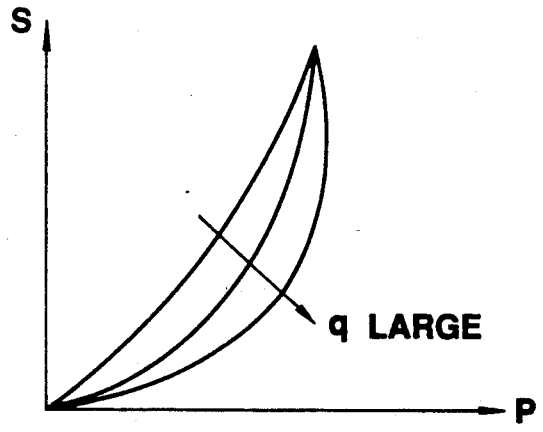
FIG. 24 is a graph showing the stored contents of non-linear table shown in FIG. 23.

The present musical tone synthesizing apparatus shown in FIG. 23 is designed to synthesize the musical tone of trumpet. Herein, the non-linear table A is constructed by ROM which stores the relation between the opening area of performer's lip and the combination of the mouth-inside pressure and tube-inside pressure. Information P to be supplied from an external device (not shown) corresponds to the mouth-inside pressure, while information q to be supplied from the filter 320*a* via a junction circuit 330 corresponds to the tube-inside pressure. In address information to be supplied to the non-linear table A, upper bits (e.g., leftmost nybble) correspond to the information P and lower bits (e.g., rightmost nybble) correspond to the information q. Based on such address information, information S corresponding to the opening area of performer's lip is read from the non-linear table A. FIG. 24 illustrates the relation between the above-mentioned information P, q and S. Incidentally, the filter 320*a* is designed in accordance with the transmission-frequency characteristic of the compression wave of air to be transmitted through the tube of trumpet.

Meanwhile, the subtractor 317 subtracts the tube-inside pressure information q from the mouth-inside pressure information P to thereby calculate information $\Delta P$ corresponding to the air pressure at the opening of performer's lip. Then, the multiplier 315 multiplies the information $\Delta P$ by the information S to thereby calculate information FL corresponding to the air-flow velocity at the opening of performer's lip. The next multiplier 316 multiplies the foregoing information G representative of the resistance of air flow at the inlet portion of the tube by the above-mentioned information FL to thereby calculate the information X representative of the progressive compression wave of air which progresses into the tube. At the input side of the filter 320*a*, the junction circuit 330 consisting of the adders 331, 332 is provided. Herein, the adder 331 adds the information X and output information of the filter 320*a* together, so that the addition result of adder 331 is supplied to the filter 320*a*. On the other hand, the adder 332 adds the output information of adder 331 and output information of filter 320*a* together, so that the addition result of adder 332, i.e., the foregoing information q is supplied to the subtractor 317 and non-linear table A. This junction circuit 330 can simulate the scattering of the compression wave of air at the connecting portion between the mouth-piece and tube.

Next, description will be given with respect to the non-linear table A. As comparing to the foregoing non-linear table 21 shown in FIG. 5 which uses the operation result between the information P and q as the address, the non-linear table A uses both of the information P and q as the address directly. For this reason, it is possible to carry out the non-linear control full of variety on the wind instrument tone. As described before, based on the information S representative of the opening area of performer's lip which is read from the non-linear table A based on the information P and q, it is possible to synthesize the musical tone of trumpet.

Figure 25:
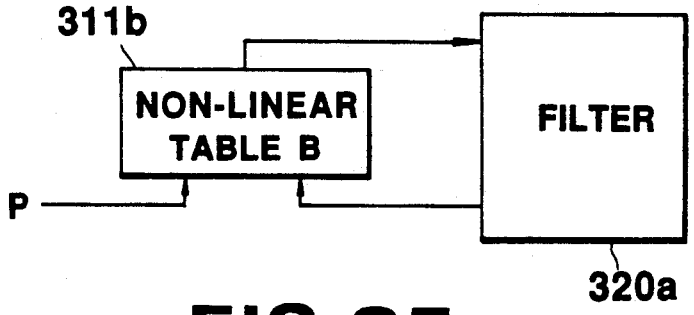
FIG. 25 is a block diagram showing a modified example of the third embodiment.

FIG. 25 is a block diagram showing a modified example of the third embodiment, wherein a non-linear table B (designated by 311*b*) is provided instead of the non-linear table A shown in FIG. 23. This non-linear table B constructed by ROM stores information indicated as "$G \cdot \Delta P \cdot S$" (where $\Delta P = P - q$) which is read by the address information P. By use of such non-linear table B, it is possible to omit the multipliers 315, 316 and the subtractor 317 shown in FIG. 23. Incidentally, the junction circuit 330 is not shown in FIG. 25.

Figure 26:
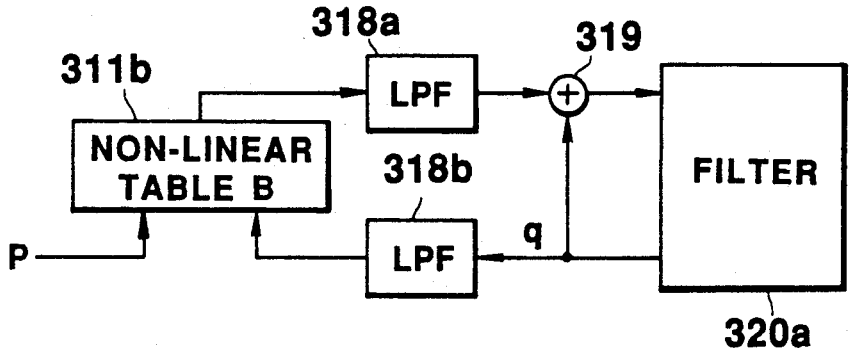
FIG. 26 is a block diagram showing another modified example of the third embodiment.

FIG. 26 is a block diagram showing another modified example of the third embodiment, wherein low-pass filters (LPF) 318*a*, 318*b* and an adder 319 are inserted between the non-linear table B and filter 320*a*. Herein, the junction circuit 330 is replaced by the adder 319 in FIG. 26.

According to this example, the LPF 318*a* can remove the quantize noise to be produced due to the operation of converting the information P, q into the information S. Due to the LPF 318*b* provided on the line from the filter 320*a* to the non-linear table B, variation of the output of non-linear table B must be delayed from variation of the information q. Thus, it is possible to simulate the reed inerrtia (or lip inertia) affecting the musical tone.

As described heretofore, this invention may be practiced or embodied in still other ways without departing from the spirit or essential character thereof. For instance, it is possible to replace the digital circuits adopted to the above-mentioned embodiments by the software processing or analog circuits. Further, the present invention can be applied to the musical instrument technique which synthesizes the acoustic instrument tones, reverberation tones etc. other than the wind instrument tone described before. Therefore, the preferred embodiments described herein are illustrative and not restrictive, the scope of the invention being indicated by the appended claims and all variations which come within the meaning of the claims are intended to be embraced therein.

What is claimed is:

1. A musical tone synthesizing apparatus comprising:

(a) excitation means for outputting an excitation signal based on an input signal and a feedback signal, the excitation means including a non-linear element for generating the excitation signal in accordance with a non-linear transfer function; and (b) bi-directional transmission means for transmitting said excitation signal outputted from said excitation means to a terminal portion as a progressive wave signal and also feeding back said progressive wave signal reflected by said terminal portion to said excitation means as a reflected wave signal, wherein the excitation means and bi-directional transmission means constitute a closed loop and a musical tone signal on which a synthesizing operation is effected is obtained by setting said closed loop formed by the excitation means and said bi-directional transmission means at resonance states;

c) adjustable delay means, including plural delay circuits disposed in said bi-directional transmission means, for transmitting said progressive wave signal and said reflected wave signal, each of said delay circuits delaying said progressive wave signal or reflected wave signal by a predetermined adjustable delay time; and (d) a plurality of junction circuits each provided for scattering said progressive wave signal and said reflected wave signal, said plurality of junction circuits being inserted between said delay circuits to couple the progressive wave signal and reflected wave signal at plural points, wherein the sum of the delay times of said delay circuits is set in accordance with the pitch of a musical tone to be generated and wherein the delay time for said progressive wave signal is not balanced with the delay time for said reflected wave signal.

2. A musical tone synthesizing apparatus according to claim 1 wherein said delay means has plural delay circuits disposed in a progressing direction in said bi-directional transmission means, but has no delay circuits disposed in reflecting direction in the transmission means.

3. A musical tone synthesizing apparatus according to claim 1 wherein said delay means has plural delay circuits disposed in a reflecting direction in said bi-directional transmission means, but has no delay circuits disposed in a progressing direction in the transmission means.

4. A musical tone synthesizing apparatus comprising;

(a) excitation means for generating an excitation signal based on an input signal corresponding to a performance operation and a feedback signal, the excitation means including a non-linear element for generating the excitation signal accordance with a non-linear transfer function; and (b) signal transmission means for transmitting said excitation signal back to said excitation means as said feedback signal with a predetermined delay time; and (c) memory means, included in said excitation means, for pre-storing the excitation signal corresponding to said input signal and feedback signal, the excitation signal being read out from the memory means by directly using the input signal and feedback signal as the address to the memory means, wherein a signal circulated in a loop including said excitation means and signal transmission means is picked up as a musical tone signal.

5. A musical tone synthesizing apparatus according to claim 7 wherein said input signal is used as upper bits of said address and said feedback signal is used as lower bits of said address.

6. A musical tone synthesizing apparatus according to claim 7 wherein said input signal is used as lower bits of said address and said feedback signal is used as upper bits of said address.

* * * * *